United States Patent [19]

Wigutow

[11] Patent Number: 4,910,055

[45] Date of Patent: Mar. 20, 1990

[54] INSULATED SLEEPING BAG

[76] Inventor: Jerald N. Wigutow, P.O. Box 12106, Columbia, S.C. 29211

[21] Appl. No.: 153,336

[22] Filed: Feb. 8, 1988

Related U.S. Application Data

[63] Continuation-in-part of Ser. No. 28,785, Mar. 23, 1987, abandoned.

[51] Int. Cl.[4] ..... A47G 13/09

[52] U.S. Cl. ..... 428/36.1; 428/36.2; 428/288; 428/284; 2/69.5; 5/413

[58] Field of Search ..... 428/288, 298, 299, 391, 428/394, 293, 359, 360, 292, 284; 2/69.5; 5/413

*Primary Examiner*—Nancy A. B. Swisher
*Attorney, Agent, or Firm*—Clifton Ted Hunt

[57] ABSTRACT

A thermal insulator for sleeping bags and protective clothing and comprising silicon treated continuous filament fibers which are unquilted and unbonded, and chopped staple fibers intermixed with opposed surfaces of the continuous filament fibers and laminated to a liner or shell fabric. The silicon treated continuous filament fibers which are unquilted and unbonded have the freedom to freely move relative to each other to achieve a loft 2 or 3 times greater than has heretofore been possible in thermal insulators for sleeping bags and protective clothing.

4 Claims, 1 Drawing Sheet

INSULATED SLEEPING BAG

CROSS REFERENCE TO RELATED APPLICATIONS

This application is a continuation-in-part of my prior application, Ser. No. 028,785, filed Mar. 23, 1987, now abandoned, and entitled INSULATOR FOR SLEEPING BAGS AND PROTECTIVE CLOTHING.

FIELD OF THE INVENTION

This invention relates to a thermal insulator for sleeping bags.

BACKGROUND OF THE INVENTION

Before the advent of synthetic fibers, down was widely used as the insulator for sleeping bags and protective clothing. Down is a small feather cluster and is sectioned off in small areas (quilted) to keep it from shifting within the bag or clothing. The internal cavity of a down sleeping bag is designed to fill in around the body and confine the body heat to the body. Down has excellent lofting characteristics which contribute to the action of the down settling closely around the body allowing few air pockets and little area to be heated by the body. It is the primary reason down has been used as an insulator, but the quilting of the down to keep it from shifting within the bag or clothing inherently inhibits lofting and results in cold spots coinciding with the quilting stitches.

The amount of loft in the insulators of sleeping bags and protective clothing is a measure of the warmth provided their occupants. Generally, the more loft, the warmer the occupant.

Synthetic fibers have been found to have the capacity for lofting when used as insulators. There are currently two types of synthetic fibers used as insulators for sleeping bags, namely, chopped staple fibers and bonded continuous filament fibers. Both are advantageous over down in that the synthetic fibers will not absorb water and will permit evaporation of body moisture through the fibers. Synthetic fibers are supplied in rolls, like yard goods, to the manufacturers of insulators for sleeping bags and protective clothing. The rolls of fibers are then cut into layers of desired dimensions and weight.

Chopped staple fibers are used as an insulator between the outer shell and the inner liner of the quilted sleeping bag shown in Lauren D. Worley U.S. Pat. No. 3,584,323 issued Sept. 10, 1969 for MULTI-PURPOSE SLEEPING BAG CONSTRUCTION. The quilting lessens the loft of the chopped staple and defines cold spots coinciding with the quilting stitches.

Bonded continuous filament fibers used in quilted insulators are subject to the same objection—inhibition of loft and cold spots coinciding with the quilting stitches.

Bonded continuous filament fibers have also been used in unquilted insulators secured only by perimeter stitching to the shell and liner fabrics. The unquilted insulators formed from bonded continuous filament fibers are advantageous over quilted insulators formed from the same material because the lofting of fibers is unrestricted by quilt stitches and a uniform loft is achieved throughout the area of the insulator. The prior art insulator of unquilted but bonded continuous filament fiber is approximately the same weight as a down insulator made for the same temperature range.

Each layer of bonded continuous filament fibers has a resin finish bonded and heat set on each surface of the layer which holds the surface fibers together and enables satisfactory handling of the fibers during manufacture of an insulator. However, the bonding of the fibers with resin restricts the amount of loft.

The prior art insulator of unquilted but bonded continuous filament fiber retains its original loft after being washed and, in fact, has a slight increase in loft after each of its first five or six washes. The increase in loft of bonded continuous filament insulators after washing is in sharp contrast to the loss of loft following washing of quilted sleeping bags made from down or chopped staple.

It has been found that the amount of loft in an insulator made from continuous filament fibers can be increased significantly by eliminating the resin bonding previously thought necessary to control the fibers while making insulators. Insulators made from unquilted and unbonded continuous filament fibers have 2 to 3 times the loft of the prior art insulators made from unquilted but bonded continuous filament fibers.

SUMMARY OF THE INVENTION

The insulator of this invention is formed from unquilted and unbonded continuous filament fibers provided with a silicon finish and layered between outer layers of chopped staple fibers. It has been surprisingly found that the known practice of intermingling continuous filament fibers with outer layers of chopped staple fibers sufficiently stabilizes the continuous filament fibers to permit their use in making insulators for sleeping bags and protective clothing.

It is preferred that the same 5 denier continuous filament polyester yarn conventionally used in insulators for sleeping bags be used in the present invention, although the invention is equally applicable to any size and type of yarn used or to be used in the manufacture of insulators for sleeping bags and protective clothing. The silicon finish may be applied during manufacture of the continuous filaments in a known manner as described, for example, in Watson, U.S. Pat. No. 3,952,134 issued Apr. 20, 1976 for CONTINUOUS FILAMENT PRODUCT.

Conventional staple fibers of a known type and size of synthetic yarn, such as 5 denier polyester, are then intermingled in a known manner with opposed surfaces of a quantity of the siliconized continuous filament fibers to form batting (hereinafter called insulator stock). Layers of such insulator stock are available in rolls, like yard goods, and have been previously used in the stuffing of pillows but not, to applicant's knowledge, in the manufacture of insulators for sleeping bags or protective clothing.

According to the invention, an insulator is made from a layer of insulator stock having a selected size and weight, as noted above, by laminating one surface of insulator stock to a liner formed from nylon taffeta or the like. An outer shell which may be also made of nylon taffeta extends about the insulator to provide a protective covering.

A sleeping bag designed for a specific temperature range such as above 20° F., for example, requires a 5 ounce layer of insulator stock for the insulator in the bottom of the bag and another 5 ounce layer of insulator stock for the insulator in the top of the bag. Insulator stock of suitably lighter weight may be used similarly for protective clothing.

DETAILED DESCRIPTION OF THE INVENTION

Figure 1:
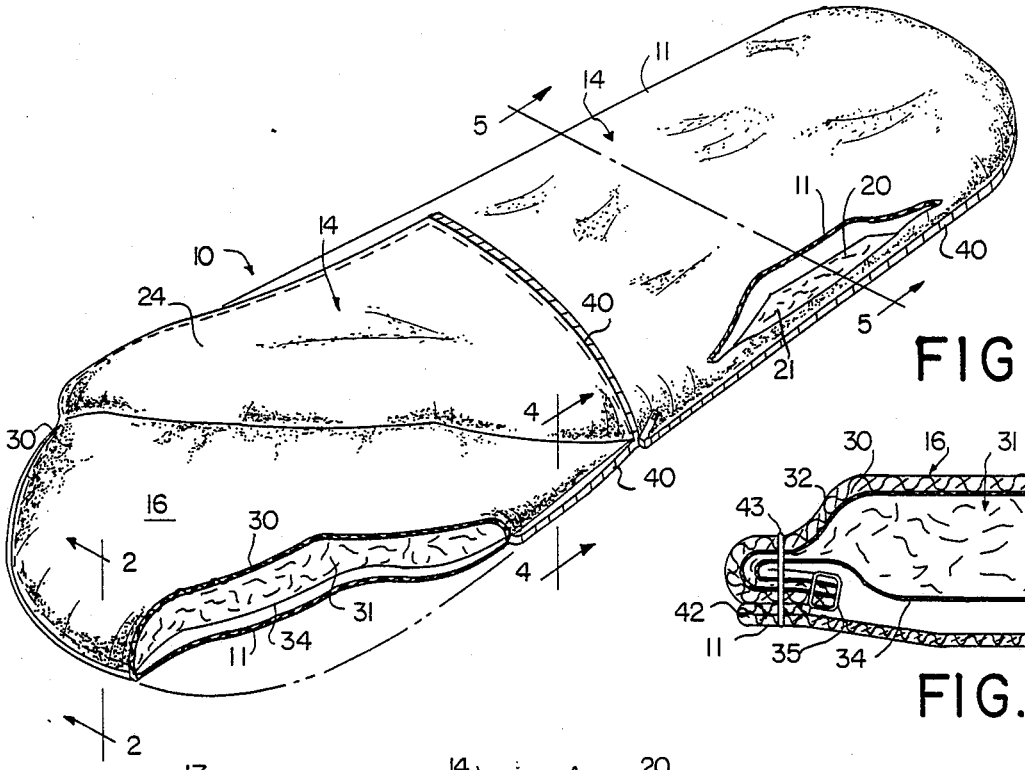
FIG. 1 is a perspective view looking at the head and partially unfolded top of a sleeping bag with parts broken away to illustrate the insulator.

Referring more specifically to the drawings, a sleeping bag is broadly designated by the reference character 10. An external shell 11, formed of nylon taffeta in the illustrated embodiment but which may be formed of any desired material, forms the outer covering of the sleeping bag, extending over the top and bottom of the bag and sewn together as at 12 along the left side of the bag in FIG. 5. The external shell 11 is sewn to the right side of the bag in FIG. 5 by assembly stitching 13 extending through the components of a top layer of insulator stock 14 and by assembly stitching 15 extending through the components of a bottom layer of insulator stock 16.

Figure 3:
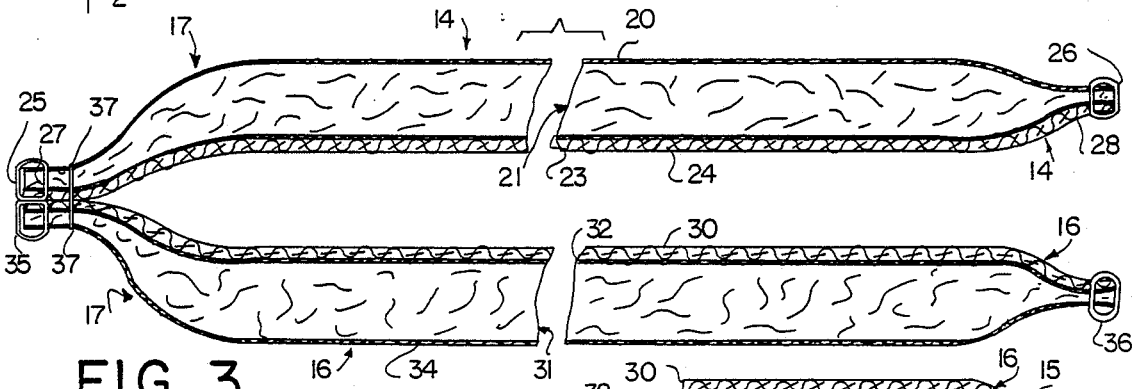
FIG. 3 is a sectional view, with parts broken away, of the sub-assembly of the sleeping bag shown in FIG. 1.
Figure 4:
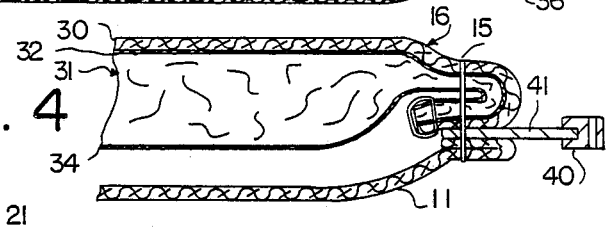
FIG. 4 is a sectional view taken substantially along the line 4—4 in FIG. 1.

FIG. 3 illustrates a sub-assembly 17 of the top layer of insulator stock 14 and the bottom layer of insulator stock 16 before the external shell 11 is applied. The upper surface of top layer 14 is defined by a first or top layer of chopped staple fibers 20 intermingled with the proximal or top surface of a layer of siliconized unbonded continuous filament fibers 21. A second or lower layer of chopped staple fibers 23 is intermingled with the opposite or lower surface of the fibers 21 to complete the top layer of insulator stock 14.

The illustrated insulator stock 14 includes a 5 ounce layer of the continuous filament fibers 21, which extend all the way between the left side 25 and the right side 26 of the top insulator stock 14 and through perimeter stitching 27 and 28 which secures the continuous filaments along the side edges 25 and 26. The number and weight of layers in the insulator 14 depends on the environmental temperature for which the insulator is intended.

The lower surface defined by the staple fibers 23 of the top insulator stock 14 is adhered by adhesive, not shown, to an inner layer 24 which may be made of a desired fabric such as the nylon taffeta of the external shell 11.

The upper surface of the bottom layer of insulator stock 16 of sub-assembly 17 is an inner liner 30 preferably formed from the same material as the inner liner 24 of the top layer 14. The chopped staple surface 32 of a lower layer of siliconized unbonded continuous filament fibers 31 is adhered to the inner surface of liner 30 by adhesive, not shown.

The lower surface of insulator 16 is defined by chopped staple fibers 34.

The unbonded continuous filament fibers 31 extend all the way between the left edge 25 and the right edge 26 of the sub-assembly 17 and through perimeter stitching 35, 36 which secure the unbonded continuous filaments along the edges 25 and 26. The upper layer 14 and the lower layer 16 of the sub-assembly 17 are connected together along the left edge 25 by assembly stitching 37 spaced inwardly from the perimeter stitching 27 and 35 and extending through all of the components of the insulators 14 and 16.

Figure 5:
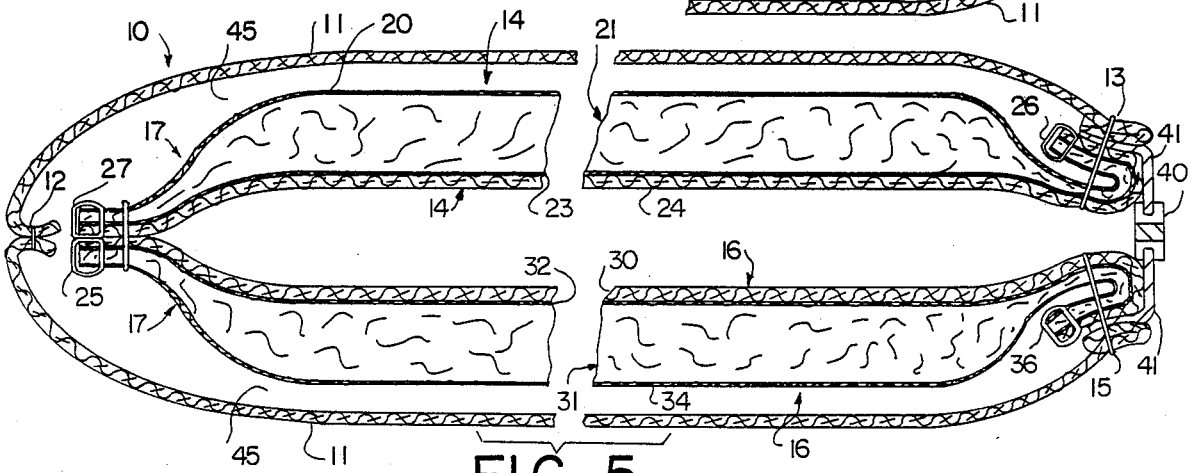
FIG. 5 is a sectional view taken substantially along the line 5—5 in FIG. 1.

A zipper 40 extends along the right edge of the sleeping bag and its fabric edges 41 are secured between the external shell 11 and the right side of the sub-assembly 17 by the assembly stitches 13 and 15 (FIG. 5).

Figure 2:
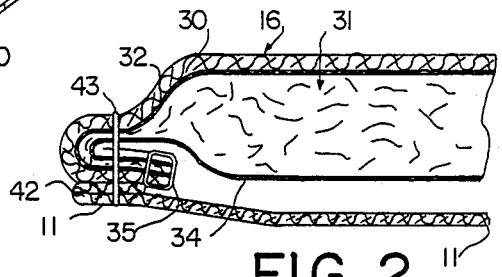
FIG. 2 is a sectional view taken substantially along the line 2—2 in FIG. 1.

Referring to FIG. 2, the external shell 11 is folded upon itself to form a hem as at 42 and fastened to the components of the bottom portion 16 by assembly stitching 43. As illustrated, the external shell 11 is not adhesively bonded at any point to the sub-assembly 17 and is connected to it only by assembly stitching 13 and 15 along the length of the zipper 40 and by the assembly stitching 43 around the radius of the head of the sleeping bag. Air space 45 between the external shell 11 and the insulators 21 and 31 in the sub-assembly 17 provides insulation and also provides room for increasing loft of the insulator after repeated washings.

It is an important aspect of this invention that the insulators 14 and 16 include unbonded continuous filament fibers 21 and 31 which extend across the sub-assembly and are not quilted, but secured only by perimeter stitching 27, 28 and 35, 36, leaving the continuous filament fibers free to loft without restriction. The fact that the continuous filaments in the insulators 21 and 31 are not bonded enables relative movement between the filaments resulting in much greater loft than was possible with the prior art unquilted insulator made from bonded continuous filament fibers.

One washing of sleeping bags or protective clothing containing insulators made according to the invention provides a 10% increase in the loft of the insulators. Successive washes (up to five or six) gives the insulators increasingly more loft. It will be remembered that the warmth of the occupant increases with the loft of the insulator.

There is thus provided an insulator which provides more warmth to the occupant with less weight than has heretofore been possible.

Although specific terms have been used in describing the invention, they are used in a descriptive and generic sense only and not for purpose of limitation.

I claim:

1. An insulated sleeping bag comprising a sub-assembly and an insulated shell, said sub-assembly including a top layer and a bottom layer of insulator stock, said top layer of insulator stock comprising a first layer of chopped staple fibers defining its upper surface, continuous filament fibers intermixed with the said first layer of chopped staple fibers and the continuous filament fibers extending laterally between opposed edges of the said top layer of insulator stock, a second layer of chopped staple fibers intermixed with the surface of the continuous filament fibers opposite the said first layer of chopped staple fibers, an inner liner formed of nylon taffeta or the like adhered to the second layer of chopped staple fibers and intermixed continuous filament fibers, first perimeter stitching extending through the top layer of insulator stock, said bottom layer of insulator stock including a second inner liner formed of nylon taffeta or the like defining its upper surface, a layer of chopped staple fibers and a layer of continuous filament fibers with the chopped staple fibers intermixed with the top surface of the layer of continuous filament fibers and adhered to said second inner liner, said continuous filament fibers in said bottom layer of insulator stock extending laterally between opposed edges of said bottom layer of insulator stock, second perimeter stitching extending around the edges of the bottom layer of insulator stock, said second perimeter stitching extending through the bottom layer of insulator stock, assembly stitching connecting the top and bottom of the sub-assembly together along one edge of the sub-assembly, and assembly stitching connecting the external shell to the edge of the sub-assembly opposite said one edge of the sub-assembly.

2. An insulated sleeping bag comprising a top layer and a bottom layer of insulator stock, each said layer of insulator stock comprising at least one layer of unbonded and unquilted silicon treated continuous filament fibers, outer layers of chopped staple synthetic fibers intermixed with the said continuous filament fibers, and a fabric liner formed of nylon taffeta or the like joined by adhesive to one of the outer layers of staple fibers.

3. An insulated sleeping bag according to claim 2 wherein inner of said fabric adhered liners are to the proximal surfaces of both the top and bottom layers of insulator stock.

4. An insulated sleeping bag according to claim 3 including an external shell adhered in surrounding relation to the top and bottom layers of insulator stock.

* * * * *